US006782230B2

(12) United States Patent
Yaomin et al.

(10) Patent No.: US 6,782,230 B2
(45) Date of Patent: Aug. 24, 2004

(54) FIXING BELT, AND IMAGE HEAT FIXING ASSEMBLY

(75) Inventors: Zhou Yaomin, Saitama (JP); Kazuo Kishino, Kanagawa (JP); Hideyuki Yano, Shizuoka (JP); Masahiro Suzuki, Shizuoka (JP); Koji Sasaki, Saitama (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/457,360

(22) Filed: Jun. 10, 2003

(65) Prior Publication Data

US 2003/0228179 A1 Dec. 11, 2003

(30) Foreign Application Priority Data

Jun. 11, 2002 (JP) ..... 2002-170593

(51) Int. Cl.[7] ..... G03G 15/20
(52) U.S. Cl. ..... 399/326; 399/333
(58) Field of Search ..... 399/329, 328, 399/333; 219/216

(56) References Cited

U.S. PATENT DOCUMENTS

| | | | | |
|---|---|---|---|---|
| 5,027,160 A | | 6/1991 | Okada et al. | 355/282 |
| 5,608,508 A | | 3/1997 | Kumagai et al. | 399/339 |
| 5,753,348 A | | 5/1998 | Hatakeyama et al. | 428/195 |
| 5,765,086 A | | 6/1998 | Kishino et al. | 399/329 |
| 5,939,337 A | | 8/1999 | Hatakeyama et al. | 442/6 |
| 5,950,061 A | | 9/1999 | Ota et al. | 399/333 |
| 6,078,780 A | | 6/2000 | Abe et al. | 399/328 |
| 6,321,062 B1 | | 11/2001 | Kitano et al. | 399/333 |
| 6,377,777 B1 | | 4/2002 | Kishino et al. | 399/329 |
| 6,482,528 B2 | * | 11/2002 | Anada et al. | 428/472 |
| 6,564,033 B2 | | 5/2003 | Zhou et al. | 399/329 |
| 2003/0053814 A1 | | 3/2003 | Suzuki et al. | 399/69 |
| 2003/0086737 A1 | | 5/2003 | Shida et al. | 399/330 |

FOREIGN PATENT DOCUMENTS

| | | | |
|---|---|---|---|
| JP | 6-222695 | | 8/1994 |
| JP | 7-13448 | | 1/1995 |
| JP | 7-114276 | | 5/1995 |
| JP | 9-34286 | | 2/1997 |
| JP | 2706432 | | 10/1997 |
| JP | 10-48976 | | 2/1998 |
| JP | 2001-215820 | | 8/2001 |
| JP | 2002-148975 | | 5/2002 |
| JP | 2002-206188 | * | 7/2002 |

* cited by examiner

*Primary Examiner*—Quana Grainger
(74) *Attorney, Agent, or Firm*—Fitzpatrick, Cella, Harper & Scinto

(57) ABSTRACT

In a fixing belt having at least a release layer and a metal layer formed of electroformed nickel, the electroformed nickel has, in its crystal texture, crystallites having an average size of 0.05 $\mu$m or more and 0.2 $\mu$m or less. This fixing belt has high durability, and an image heat fixing assembly using this fixing belt has high durability and high reliability and realizes low-energy heating by utilizing a heating element with a small heat capacity.

10 Claims, 9 Drawing Sheets

FIXING BELT, AND IMAGE HEAT FIXING ASSEMBLY

BACKGROUND OF THE INVENTION

1. Field of the Invention

This invention relates to a fixing belt used in image-forming apparatus such as electrophotographic apparatus and electrostatic-recording apparatus, and an image heat fixing assembly with which unfixed images formed and held on recording mediums are subjected to heat fixing.

2. Related Background Art

In the image-forming apparatus, heat roller type assemblies have been in wide use as fixing assemblies with which unfixed images (toner images) of intended information which have been formed and held on recording mediums (such as transfer material sheets, electrofax sheets, electrostatic-recording paper, OHP sheets, printing paper and format paper) by a transfer system or a direct system at a zone where an electrophotographic process, an electrostatic-recording process or a magnetic-recording process is carried out are heat-fixed as permanently fixed images to the recording mediums. Such assemblies are commonly those making use of a heat source such as a halogen heater in the roller.

Meanwhile, as heating systems, those in which a resin belt or metal belt having a small heat capacity is heated using a ceramic heater as a heat source are widely proposed and carried out. More specifically, in such heating systems, it is common to make a heat-resistent belt (fixing belt) held between the ceramic heater as a heating element and a pressure roller as a pressing means to form a nip, and guide a recording medium on which unfixed toner images to be imagewise fixed have been formed and held, into the part between the fixing belt and the pressure roller at the nip so that the recording medium is transported together with the belt while being held between them, to impart the heat of the ceramic heater to the recording medium at the nip via the belt, where the unfixed toner images are heat-and-pressure-fixed to the recording medium surface by the heat and the pressure at the nip.

As fixing assemblies of this belt heating system, on-demand type assemblies can be set up using a low-heat-capacity member as the belt. More specifically, the ceramic heater as a heat source may be electrified only when the image-forming apparatus performs image formation, to bring the heater into a state it has generated heat at a stated fixing temperature. Thus, there is an advantage that the image-forming apparatus can have a short waiting time from power source ON to a image formation performable state (i.e., quick-start performance) and hence can enjoy a low power consumption when it is on stand-by (i.e., power saving).

As fixing belts of such a belt heating system, heat-resistant resin belts are used. In particular, polyimide resin belts are used as having good strength. However, where machines are made to have more high-speed and high-durability, such resin belts (films) are insufficient in respect of the strength. Accordingly, it is proposed to use a belt having a base layer formed of a metal having superior strength, as exemplified by SUS stainless steel, nickel, copper or aluminum.

Also proposed is, as disclosed in Japanese Patent Application Laid-open No. 7-114276, an induction heating system in which a metal belt is used and this belt is made to generate heat by itself through eddy currents produced by electromagnetic induction. More specifically, a heating assembly is proposed in which eddy currents are induced in the belt itself or in a conductive member set to be adjacent thereto, by a variation of magnetic flux to make it generate heat by Joule effect. This electromagnetic-induction system can set heat generation area closer to the member to be heated, and hence can achieve an improvement in efficiency of the energy to be consumed.

As methods of driving the fixing belt of the fixing assembly of a belt heating system, available are, e.g., a method in which a belt brought into pressure contact between a pressure roller and a belt guide which guides the inner surface of the belt is rotated by the rotational driving of the pressure roller (pressure roller drive system), and a method in which in reverse the pressure roller is rotated by the driving of an endless-belt type belt put over a drive roller and a tension roller.

As fixing belts making use of a metal belt, the use of a fixing belt made of nickel with a surface roughness of less than 0.5 $\mu$m and a thickness of about 40 $\mu$m is disclosed as an example in Japanese Patent Application Laid-open No. 7-13448; and in Japanese Patent Application Laid-open No. 6-222695 a fixing belt made of nickel with a thickness of from 10 to 35 $\mu$m, having on its outer periphery a coating layer having releasability and on its inner periphery a resin layer.

Endless belts made of nickel are readily obtainable by a nickel electroforming process. Conventionally, the nickel electroforming process is utilized for the purpose of improving wear resistance or providing glossiness as decorative use. Hence, the resulting electroformed nickel usually contains sulfur in a large quantity. Where this electroformed nickel is used in the fixing belt, a problem may arise in durability because of embrittlement due to sulfur in a high-temperature condition.

As countermeasures therefor, as disclosed in Japanese Patent Application Laid-open No. 10-48976, a fixing belt is proposed which is comprised of a nickel metal layer containing 0.04% by weight or less of sulfur and 0.2% by weight or more of manganese, for the purpose of improving heat resistance and durability. As also disclosed in Japanese Patent No. 2706432, a fixing belt is proposed which employs as a substrate an endless electroformed sheet formed of a nickel-manganese alloy containing from 0.05 to 0.6% by weight of manganese and having a Vickers microhardness of from 450 to 650.

However, in the case of the belt heating system, in particular, the belt heating system making use of the metal belt, the belt tends to fatigue mechanically because it flexes repeatedly at the nip and in its backward and forward vicinity as the belt itself is rotated. Accordingly, it is sought to more improve the heat resistance and durability.

Now, it is considered that both strength and toughness of materials can be better achieved as the materials have a smaller crystal grain diameter. Under the conditions of electroforming, however, large-crystal texture is obtained. Hence, usually, a primary brightener containing sulfur used as a stress reducer is added. The sulfur-nickel compound formed on the cathode surface (mold) is in the form of microscopic grains, and hence has a crystal grain diameter which is smaller in about double figures. Thus, it can impart glossiness to electroformed products, but inevitably has too small a crystal grain diameter.

SUMMARY OF THE INVENTION

An object of the present invention is to provide a fixing belt having high durability and an image heat fixing assembly having high durability and high reliability, in an image heat fixing assembly which can realize low-energy heating by utilizing a heating element with a small heat capacity.

The present invention is a fixing belt having at least a release layer and a metal layer formed of electroformed nickel;

the electroformed nickel having, in its crystal texture, crystallites having an average size of from 0.05 μm or more to 0.2 μm or less.

The present invention is also an image heat fixing assembly having the above fixing belt and a pair of pressure contact members which are mutually in pressure contact via the fixing belt; the inner surface of the fixing belt being slidable on one of the pressure contact members, and an image held on a recording medium being heat-fixed by the aid of the heat conducted from the fixing belt.

The present invention is still also an image heat fixing assembly having a magnetic-flux generation means which produces-a magnetic flux, and the above fixing belt generates heat in virtue of the magnetic flux produced by the magnetic-flux generation means to heat and fix the image held on a recording medium.

In the present invention, the crystallites in the crystal texture of the electroformed nickel are made to have an average size of from 0.05 μm or more to 0.2 μm or less. This makes it possible to provide a fixing belt having superior high durability, in particular, durability at high temperature, and an image heat fixing assembly having high durability and high reliability.

DETAILED DESCRIPTION OF THE PREFERRED EMBODIMENTS

The fixing belt of the present invention has at least a release layer and a metal layer formed of electroformed nickel. The electroformed nickel has, in its crystal texture, crystallites having an average size of from 0.05 μm or more to 0.2 μm or less. The crystallites in the crystal texture of the electroformed nickel may preferably have an average size of 0.07 μm or more, and more preferably 0.08 μm or more. The crystallites in the crystal texture of the electroformed nickel may also preferably have an average size of 0.15 μm or less, and more preferably 0.12 μm or less.

In the present invention, making the crystallites in the crystal texture of the electroformed nickel have the average size of from 0.05 μm or more to 0.2 μm or less can ensure sufficient heat resistance and durability.

The electroformed nickel may also preferably have, in its sectional crystal texture, crystal grains having an average size [(b+a)/2] of from 0.1 μm or more to 3 μm or less where the length of a crystal grain is represented by b and the breadth thereof by a, and its area percentage occupied by texture in which the crystal shape factor which is the ratio (b/a) of length b to breadth a of a crystal grain is 2 or less may preferably be 50% or more, and more preferably 80% or more. The electroformed nickel may further preferably have, in its sectional crystal texture, crystal grains having an average size [(b+a)/2] of from 0.5 μm or more to 1.5 μm or less, and its area percentage occupied by texture in which the crystal shape factor which is the ratio (b/a) of length b to breadth a of a crystal grain is from about 0.8 to 1.3 may particularly preferably be 80% or more.

The crystal texture may preferably be one forming grain arrangement having a regularity. The crystal texture having a regularity is advantageous in respect of flexibility, and suits with the fixing belt, which is required to have flexing properties.

Figure 1:
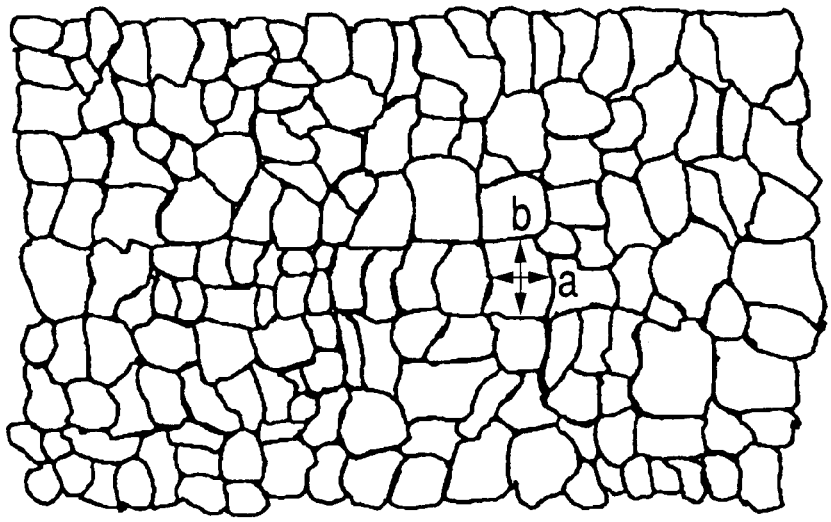
FIG. 1 is a view for describing the definition of the average size [(b+a)/2] of crystal grains and the ratio (b/a) of length b to breadth a of a crystal grain, in the fixing belt according to the present invention.

In the present invention, as shown in FIG. 1, the average size of crystal grains are defined as (b+a)/2 and the shape factor as b/a where the length of a crystal grain is represented by b and the breadth thereof by a. The length (b) refers to the maximum length of a crystal grain, and the breadth (a) refers to the maximum length thereof in the direction perpendicular to the length (b).

In the present invention, the regularity of the sectional crystal texture is also defined as follows: With respect to each of crystal grains at optional three positions, the scattering of angles to the direction of growth in length of 10 crystal grains each which are continuously contiguous in the direction vertical to the direction of growth of crystal grains (the direction of electric current at the time of electroforming) is 30° or less.

The electroformed nickel is formed in a film from a Watts bath of nickel sulfate or a nickel sulfamate bath, kept at 70° C. or below. Its formation includes processes such as the formation and growth of nuclei at the mold surface, the formation of crystallites, and the formation of crystal grains by coalescence of the crystallites. Where a metal is electrodeposited by dissolving the anode, the electrodeposited metal usually shows columnar structure having axes in the direction of electric current, i.e., the direction vertical to the cathode (mold). Where the sulfur, a decomposition product of a primary brightener as a result of electrical reduction, has been incorporated in a coating layer in a large quantity, the interior of columnar product has a structure of fine crystals. Such a fine-crystal texture is a texture consisting of crystallites having no orientation and having a small size, without coming to be crystal grains.

Conventionally, in electroformed nickel commonly available, the sectional crystal texture is a fine-crystal texture, a columnar texture or a dendritic texture. Hence, in fixing belts as well, electroformed nickel having such texture has been used. On the other hand, in the present invention, the electroformed nickel as described above is used. This can bring an improvement in durability to ensure sufficient heat resistance and durability. In addition, as stated previously, the crystal texture having regularity is advantageous in respect of flexibility, and suits with the fixing belt, which is required to have flexing properties.

If the crystallites have an average size of less than 0.05 μm, the crystal texture of the electroformed nickel comes to fine-crystal or acicular texture. It, in the case of fine crystals, means that the size of crystallites is the same as the size of crystal grains. If on the other hand the crystallites have an average size of more than 0 μm, the crystal texture of the electroformed nickel comes to a coarse texture.

If in the sectional crystal texture the crystallites have an average size of less than 0.1 μm, the crystal texture of the electroformed nickel may come to fine-crystal texture to cause a problem in regard to the flexibility of the fixing belt. On the other hand, if in the sectional crystal texture the crystallites have an average size of more than 3 μm, the crystal texture of the electroformed nickel may come to a coarse columnar texture, so that the fixing belt may not satisfy the basic properties (tensile strength and hardness) required in its extensive operation (running), and may come to tend to be destroyed by the flexing of the belt. In the present invention, making the crystallites in the sectional crystal texture have the average size of from 0.1 μm or more to 3 μm or less can ensure sufficient durability.

If the crystal shape factor is more than 2, the crystal texture of the electroformed nickel may come to coarse columnar texture to cause ill effects on the strength, flexibility, running time and so forth required in the belt.

(1) Fixing Belt 10

The fixing belt of the present invention is described below.

Figure 2:
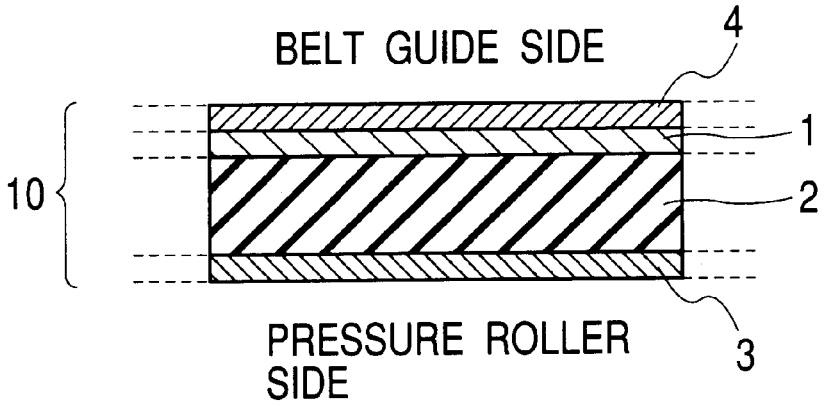
FIG. 2 is a diagrammatic view showing an example of the layer construction of the fixing belt according to the present invention.

FIG. 2 is a diagrammatic view showing an example of the layer construction of a fixing belt 10 in this embodiment. The fixing belt 10 of this embodiment has a composite structure made up of a metal layer 1 constituted of an electroformed-nickel endless belt serving as a base layer, an elastic layer 2 laminated to the outer surface of the metal layer 1, a release layer 3 further laminated to the outer surface of the elastic layer 2, and a sliding layer 4 laminated to the inner surface of the metal layer 1. In the fixing belt 10, the sliding layer 4 is on the inner surface side (belt guide side), and the release layer 3 is on the outer surface side (pressure roller side). A primer layer (not shown) for bonding may be provided between the metal layer 1 and the elastic layer 2, between the elastic layer 2 and the release layer 3 and between the metal layer 1 and the sliding layer 4. The primer layer may be formed using a known material of a silicone type, an epoxy type, a poly(amide-imide) type or the like, and may usually be in a thickness of approximately from 1 μm to 10 μm.

Figure 3:
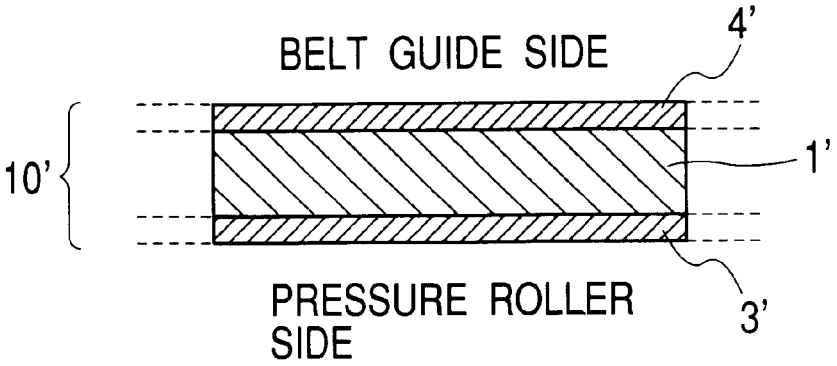
FIG. 3 is a diagrammatic view showing another example of the layer construction of the fixing belt according to the present invention.

FIG. 3 is a diagrammatic view showing another example of the layer construction of a fixing belt 10' in this embodiment. The fixing belt 10' of this embodiment has a composite structure made up of a metal layer 1' constituted of an electroformed-nickel endless belt serving as a base layer, a release layer 3' laminated to the outer surface of the metal layer 1', and a sliding layer 4 laminated to the inner surface of the metal layer 1'. In the fixing belt 10', the sliding layer 4' is on the inner surface side (belt guide side), and the release layer 31 is on the outer surface side (pressure roller side). A primer layer (not shown) for bonding may be provided between the metal layer 1' and the release layer 3' and between the metal layer 1' and the sliding layer 41. As the primer layer, the same one as that in the belt shown in FIG. 2 may be provided. In particular, where the fixing belt is used to heat-fix monochrome images having a relatively small toner layer unevenness, it may have such a form as the above in which the elastic layer is omitted.

Where this fixing belt 10 or 10' is used in the electromagnetic-induction heating system, the metal layer 1 or 1' constituted of an electroformed-nickel endless belt functions as a heat generation layer exhibiting electrormagnetic-induction heat generation properties. As described later, an alternating magnetic flux acts on the metal layer 1 or 1' to cause eddy currents in the metal layer 1 or 1', so that the metal layer 1 or 1' generates heat. This heat is conducted to the fixing belt 10 or 10' via the elastic layer 2 and release layer 3 or via the release layer 3', and the fixing belt 10 or 10' heats a recording medium fed to a fixing nip N, where the heat fixing of toner images is performed.

The fixing belt 10 or 10' of the present invention may also be used in a belt heating system making use of a ceramic heater. As described later, in this case, the heat of the ceramic heater is imparted to the recording medium via the fixing belt 10 or 10', so that the toner images are heat-fixed to the surface of the recording medium.

a. Metal Layer 1 (or 1')

The metal layer 1 is formed of nickel (inclusive of an alloy thereof) grown on the surface or back of a mold by an electroforming process by immersing in an electroforming bath a cylindrical mold made of SUS stainless steel or the like. As described above, in the crystal texture of this electroformed nickel, the crystallites have the average size of from 0.05 μm or more to 0.2 μm or less. Also, the electroformed nickel may also preferably have, in its sectional crystal texture, crystal grains having an average size [(b+a)/2] of from 0.1 μm or more to 3 μm or less where the length of a crystal grain is represented by b and the breadth thereof by a, and the area percentage occupied by texture in which the crystal shape factor which is the ratio (b/a) of length b to breadth a of a crystal grain is 2 or less may preferably be 50% or more.

The size of crystallites of the electroformed nickel is measured with an X-ray diffraction apparatus on Ni (111) diffraction plane and using characteristic X-ray Cu—K (wavelength: 1.5405620 A), and is found by including in the Hall's equation the results of measurement of the extent (integral width) of the diffraction profile.

Incidentally, in the present invention, it is considered that the crystallites of the electroformed nickel have no in-plane orientation because the manner of orientation does not change depending on the direction of the sample when their size is measured changing the direction of the plane of the measuring sample or of the plane parallel to the mold. Hence, in the measurement of the size of crystallites, the sample may be stuck to a plastic plate in a flat state to make measurement in any desired direction.

As to the breadth a and length b of the sectional crystal texture, 50 pieces of crystal texture are picked up at random from an SEM (scanning electron microscope) photograph of the sectional crystal texture of the electroformed nickel to measure them. Then, on the basis of the measured values obtained, an average value of the size (a+b)/2 of the crystal grains and an average value of the shape factor b/a thereof are found.

The sectional crystal texture of the electroformed nickel is considered to be texture formed by the coalescence of crystallites. The size of crystallites of coatings, i.e., electroformed materials (electroformed nickel) formed by the electroforming does not remarkably differ among fine-crystal texture, columnar texture, dendritic texture and granular texture, and is said to be from several nm to tens of nm. When the over-voltage is high in the electroforming process or the brightener is added in a large quantity, the rate of deposition of atoms comes faster than the rate of crystal growth and, correspondingly thereto, the rate of nuclei formation comes higher, so that the size of crystallites becomes 0.05 $\mu$m or less to come into fine-crystal texture.

In the present invention, the electroformed nickel may preferably be one in which the sectional crystal texture having an optimum crystal texture size is composed of grain arrangement having a given regularity. Such electroformed nickel can be obtained by controlling the composition of an electroforming bath and the process of electroforming.

In the case of fine-crystal texture whose crystallites have a size of from several nm to tens of nm, which is obtained when a brightener containing sulfur is added in a large quantity, usually the orientation of crystals is random and has no regularity. On the other hand, in the case of columnar texture whose crystallites have a size of 3 $\mu$m or more, which is obtained when a brightener containing sulfur is added in a very small quantity, usually the arrangement of crystal grains is disordered.

The electroformed-nickel endless belt of the present invention may also contain, in addition to nickel, element(s) such as sulfur, carbon, cobalt, manganese and/or iron.

The sulfur which may become deposited in nickel electroforming may preferably be in a content of 0.03% by weight or less, and more preferably 0.02% by weight or less. The sulfur component in nickel electroforming is an essential component which decreases electroforming stress and improves molding precision, but on the other hand it damages flexibility, and elasticity at high temperature, and is closely concerned in a phenomenon of break due to metal fatigue. If the sulfur is present in too large quantity, the sulfur may form brittle films around nickel grain boundaries in a high-temperature condition, so that the crystal boundaries of electroformed nickel may come into discontinuity, tending to cause brittle fracture in some cases. There are no particular limitations on the lower limit of the content of sulfur, which, usually, is about 0.001% by weight.

The electroformed nickel is produced by an electroforming process using as the cathode a mold made of, e.g., stainless steel. As an electroforming bath used here, any known nickel electroforming bath as exemplified by a sulfamic acid type may be used. Additives such as a pH adjuster, a pit preventive agent and a brightener may also appropriately be added. The nickel electroforming bath may include, e.g., a nickel electroforming bath composed of from 300 to 450 g/L of nickel sulfamate, from 0 to 30 g/L of nickel chloride and from 30 to 45 g/L of boric acid. Then, electroforming bath temperature, cathode current density and so forth may be controlled, whereby the desired electroformed nickel comprised of nickel or a nickel alloy can be obtained. The electroforming process may also differ depending on the electroforming bath to be used, Usually, it may preferably be carried out at an electroforming bath temperature of approximately from 45 to 60° C. and a cathode current density of approximately from 1 to 30 A/dm$^2$.

Usually, to produced the electroformed nickel by the electroforming process, additives called a stress reducer or primary brightener such as saccharin, sodium benzenesulfonate or sodium naphthalenesulfonate and a secondary brightener such as 2-butine-1, 4-diol, coumarin or diethyltriamine are added to the electroforming bath so that the electrodeposition stress is reduced to improve molding precision.

The primary brightener (stress reducer) makes the crystals of coatings fine and imparts glossiness thereto. Meanwhile, the secondary brightener imparts leveling and glossiness to coatings. The primary brightener produces compression stress in coatings, but the secondary brightener imparts tensile stress to coatings.

The primary brightener has a linkage of $=C—SO_2$. It imparts glossiness to coatings and at the same time prevents embrittlement due to the secondary brightener. As chief primary brighteners, sulfonic acid, sulfonamide, sodium naphthalenedisulfonate and so forth are used.

As the secondary brightener, used are metal salts such as cobalt salts, zinc salts and cadmium salts, and besides, recently organic compounds having unsaturated bonds such as C=C:, C≡C, C=N and N≡N.

The crystallite size and sectional crystal texture of the electroformed nickel is influenced by the type and amount of the brightener to be added to electroforming bath, the current density of electric current flowed to the cathode (mold), and the flow velocity of electroforming bath in the vicinity of the cathode, and can be made optimum by controlling parameters of these.

If the primary brightener containing sulfur, such as saccharin, is added to the electroforming bath in a large quantity, the sulfur becomes deposited in a large quantity together with the electrodeposition of nickel. The sulfur present on the outermost surface of electroformed nickel acts as nuclei of nickel crystals. Such co-deposition of sulfur in a large quantity makes the crystal texture of electroformed nickel into fine crystals. If the electroformed nickel is heated to 200° C. or above, the sulfur present in nickel crystals segregate at nickel grain boundaries, and sulfur brittle films are formed at the nickel grain boundaries. Hence, microcracks tend to occur at the nickel grain boundaries in the state the stress acts repeatedly as in the case of the fixing belt, tending to result in early break of the fixing belt.

Meanwhile, the addition of, e.g., butinediol, having a carbon triple bond, to the nickel electroforming bath makes the electroformed nickel have crystals oriented predominantly to (200)-plane, where, in the sectional crystal texture, the crystal grains arrange along the mold surface and the film growth direction. However, if the butinediol is added to the electroforming bath in a large quantity, any residual stress of electroformed nickel comes to an excess tensile stress to make it difficult to manufacture the fixing belt, tending to cause a lowering in the durability of the fixing belt.

Accordingly, as the amount of the brightener to be added, it is preferable to add 0.1 g/L or less of saccharin and 1 g/L or less of butinediol to the electroforming bath. It is more preferable to add the saccharin in an amount of 0.05 g/L or less and the butinediol in an amount of 0.5 g/L or less.

Electroformed nickel having a small internal stress is also obtainable by controlling electroforming process parameters, without adding any brightener at all to the electroforming bath. In such a case, however, the crystal texture tends to come coarse, also not to achieve the hardness required in the fixing belt.

Accordingly, as the lower limit of the amount of the brightener to be added, it is preferable to add 0.005 g/L or more of saccharin used as a first brightener and 0.05 g/L or more of butinediol used as a second brightener, to the electroforming bath.

The electric current flowed to the cathode (mold) may preferably be at a current density of 30 A/dm$^2$ or less, and more preferably 20 A/dm$^2$ or less. If the electric current flowed to the cathode (mold) is, at too high current density, the nickel may be deposited at a high rate, but its crystal grains tend to come coarse. Also, the electric current flowed to the cathode (mold) may preferably be at a current density of 1 A/dm$^2$ or more, and more preferably 4 A/dm$^2$ or more. If the electric current flowed to the cathode (mold) is at too low current density, the electroformed nickel tends to have fine-crystal texture or dendritic texture.

As the electroforming bath flow velocity in respect to the mold surface, it may preferably be 0.25 m/sec or more, land more preferably 0.5 m/sec or more. If the electroforming bath flow velocity in respect to the mold surface is too low, hydrogen gas produced at the mold surface may be removed by deaeration with difficulty, tending to resulting in an increase in voltage load and deterioration in resistance to burnt deposits. Also, there are no particular limitations on the upper limit of the electroforming bath flow velocity. Usually, the electroforming bath flow velocity in respect to the mold surface may preferably be 5 m/sec or less. If the electroforming bath flow velocity is too high, the flow of the electroforming bath may greatly be disordered to cause coating unevenness, tending to disorder the regularity of crystal texture. The above range is also preferred in view of the level of practical ability.

The flow rate of electroforming bath in the vicinity of the mold (about 5 to 10 mm from the mold surface) may be measured by the Pitot tube method.

The electroforming bath flow velocity in respect to the mold surface may be controlled by using an agitation method such as agitation by circulation of the electroforming bath by means of a pump, agitation by jetting of air, agitation by movement of stirring blades, or agitation by means of a multiple nozzle.

The metal layer 1 may preferably have a thickness larger than the skin depth represented by the following equation, and particularly a thickness of 1 mm or more, and also preferably 200 $\mu$m or less, and particularly 100 $\mu$m or less. Skin depth $\sigma$ (m) concerns frequency f (Hz) of exciting circuit, permeability $\mu$ and specific resistance $\rho$ ($\Omega\cdot$m), and is represented as:

$$\sigma=503\times(\rho/f\mu)^{1/2}.$$

Figure 4:
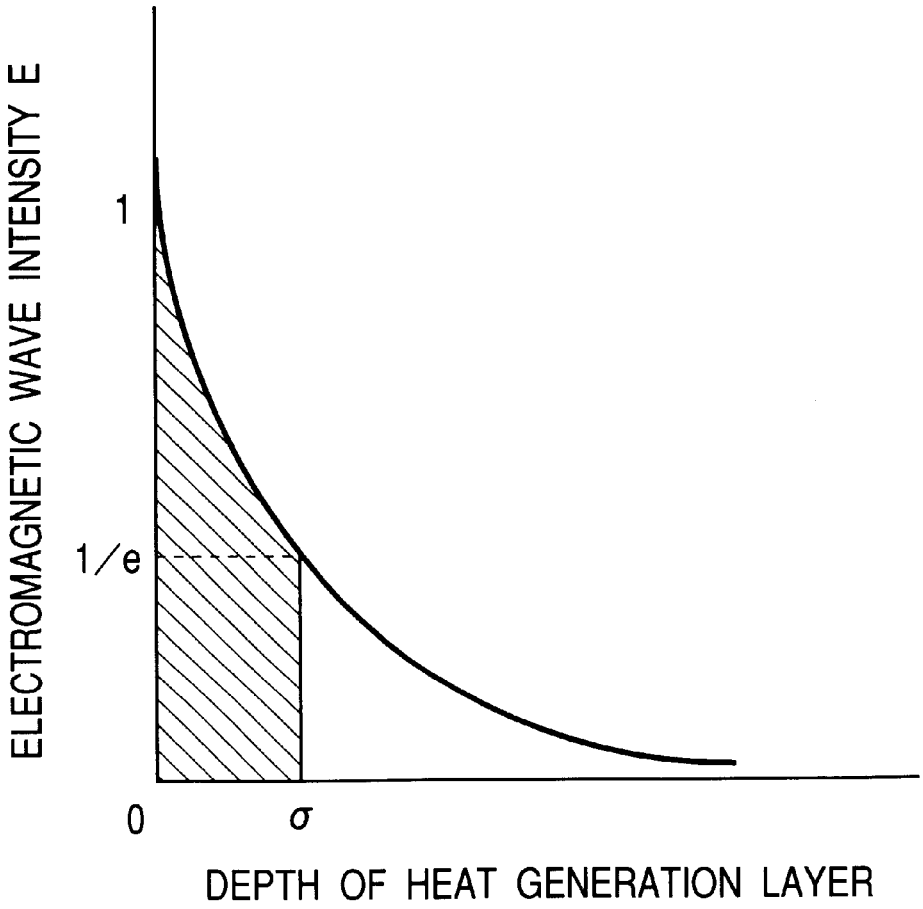
FIG. 4 is a graph showing the relationship between heat generation layer depth and electromagnetic wave intensity.

This shows the depth of absorption of electromagnetic waves used in electromagnetic induction. The intensity of electromagnetic waves is 1/e or less at a depth larger than this. Conversely, almost all of energy has been absorbed up to this depth (FIG. 4). If the metal layer 1 is too thin, almost all of electromagnetic energy can not completely be absorbed, resulting in poor efficiency in some cases. If on the other hand the metal layer 1 is too thick, it may have a high rigidity and also poor flexing properties, sometimes making it difficult for the fixing belt to be used as a rotating member. Also, when the fixing belt is used in the belt heating system making use of a ceramic heater, the metal layer 1 may preferably have a layer thickness of 100 $\mu$m or less, and particularly preferably 50 $\mu$m or less, and also preferably be 20 $\mu$m or more, in order to make its heat capacity small to improve quick-start performance.

The electroformed nickel used in the present invention is usually in the form of crystals, but may partly be amorphous. The crystals may also preferably be not fine crystals in view of hardness and flexibility.

The electroformed nickel used in the present invention, which may preferably have a Vickers hardness of from 300 to 450, has sufficient heat resistance required as the fixing belt. Accordingly, the Vickers hardness may preferably be lowered at a rate of 20% or less when heated to 450° C.

Since the electroformed nickel has sufficient heat resistance required as the fixing belt, it may also preferably have a recrystallization temperature of 450° C. or above.

The electroformed nickel may preferably have, at normal temperature, a tensile strength of from 700 to 1,500 MPa and an elongation of from 2 to 8%.

2. Elastic Layer 2

The elastic layer 2 may be provided or not provided. Inasmuch as the elastic layer is provided, it covers the images to be heated, at the nip via the release layer 3 to ensure the conduction of heat, and also compensates the restoring force of the electroformed nickel belt to relax any fatigue caused by rotation and flexing. Also, inasmuch as the elastic layer is provided, it makes the release layer surface of the fixing belt better follow the unfixed toner image surface to enable heat to be conducted in a good efficiency. The fixing belt provided with the elastic layer 2 is particularly suited to the heat fixing of full-color or multi color toner images where unfixed toners are laid on in a large quantity.

As materials for the elastic layer 2, those having good heat resistance and good thermal conductivity may be selected without any particular limitations. Such materials for the elastic layer 2 may preferably be silicone rubbers, fluorine rubbers, fluorosilicone rubbers and so forth, and silicone rubbers are particularly preferable.

The silicone rubbers used in the elastic layer 2 may be exemplified by polydimethylsiloxane, polymethyltrifluoropropylsiloxane, polymethylvinylsiloxane, polyfluorpropylvinylsiloxane, polymethylpheylsiloxane, polyphenylvinylsiloxane, and copolymers of any of these polysiloxanes.

The elastic layer 2 may also optionally be incorporated with a reinforcing filler such as dry-process silica or wet-process silica, calcium carbonate, quartz powder, zirconium silicate, clay (aluminum silicate), talc (hydrous magnesium silicate), alumina (aluminum oxide), iron red (iron oxide) or the like.

The elastic layer 2 may preferably have a thickness of 10 $\mu$m or more, and particularly 50 $\mu$m or more, and preferably 1,000 $\mu$m or less, and particularly 500 $\mu$m or less, as good fixed-image quality can be achieved. Where color images are printed, in particular, in the case of photographic images or the like, solid images are formed over a large area on a recording medium P. In this case, if the heating surface (release layer 3) can not follow up the unevenness of the recording medium or the unevenness of the toner layer, non-uniform heating may result, so that non-uniform glossiness appears on images between areas heat-conducted much and areas heat-conducted less. That is, the areas heat-conducted much have a high glossiness and the areas heat-conducted less have a low glossiness. If the elastic layer 2 is too thin, it can not follow up the unevenness of the recording medium or toner layer, non-uniform glossiness may appear on images. If on the other hand the elastic layer 2 is too thick, the elastic layer 2 may have so high heat resistance as to make it difficult to materialize the quick start.

The elastic layer 2 may preferably have a hardness (JIS-A) of 60° or less, and particularly 45° or less, as any image glossiness non-uniformity can sufficiently be prevented and good fixed-image quality can be achieved.

The elastic layer 2 may have a thermal conductivity $\lambda$ of $2.5\times10^{-3}$ W/cm·° C. or more, and particularly $3.3\times10^{-3}$ W/cm·° C. or more, and preferably $8.4\times10^{-3}$ W/cm·° C. or less, and particularly $6.3\times10^{-3}$ W/cm·° C. or less. If it has too small thermal conductivity $\lambda$, it may have a high heat resistance to make the surface layer (release layer 3) of the fixing belt undergo slow temperature rise. If it has too large thermal conductivity λ, it may have a high hardness or become worse in compression set.

Such an elastic layer 2 may be formed by a known method as exemplified by a method in which a material such as liquid silicone rubber is coated on the metal layer 1 in a uniform thickness by blade coating or the like, followed by hardening by heating; a method in which a material such as liquid silicone rubber is injected into a mold, followed by hardening by curing; a method in which the like material is extruded, followed by hardening by curing, and a method in which the like material is injection-molded, followed by hardening by curing.

c. Release Layer 3 (or 3')

As materials for the release layer 3, those having good releasability and heat resistance may be selected without any particularly limitations. Such materials for the release layer 3 may preferably be fluorine resins such as PFA (tetrafluoroethylene/perfluoroalkyl ether copolymer), PTFE (polytetrafluoroethylene) and FEP (tetrafluoroethylene/hexafluoropropylene copolymer), silicone resins, fluorosilicone rubbers, fluorine rubbers and silicone rubbers. PFA is particularly preferred.

The release layer 3 may also optionally be incorporated with a conducting agent such as carbon black and tin oxide in an amount of 10% by weight or less based on the weight of the release layer 3.

The release layer 3 may preferably have a thickness of 10 μm or more or 100 μm or less. If the release layer 3 is too thin, the layer may have poor releasability at some part because of coat non-uniformity of coating films, or may have insufficient durability. If on the other hand the release layer 3 is too thick, it may have a poor heat conduction and, especially in the case of a release layer of a resin type, it may have so high hardness as to make the elastic layer 2 no longer effective.

Such a release layer 3 may be formed by a known method. For example, in the case of a fluorine resin type one, it may be formed by a method in which a coating material with fluorine resin powder dispersed therein is applied, followed by drying and baking, or by a method in which a material made previously into a tube is put on the elastic-layer or metal layer surface and bonded thereto. In the case of a rubber type one, it may be formed by a method in which a liquid material is injected into a mold, followed by hardening by curing; a method in which the like material is extruded, followed by hardening by curing; and a method in which the like material is injection-molded, followed by hardening by curing.

A method may also be used in which a tube having previously been treated with a primer on its inner surface and an electroformed nickel having previously been treated with a primer on its outer surface are fitted in a cylindrical mold, and then liquid silicone rubber is injected into a gap between the tube and the electroformed nickel belt, followed by hardening to cure and bond the rubber. This enables the elastic layer and the release layer to be simultaneously formed.

d. Sliding Layer 4 (or 4')

The sliding layer 4 is not an essential component of the present invention, but may preferably be provided in order to achieve the reduction of drive torque applied when the image heat fixing assembly of the present invention is operated. Inasmuch as the sliding layer 4 is provided, the heat generated in the metal layer (heat generation layer) 1 can be insulated so as not to turn toward the inside of the fixing belt. Hence, compared with a case in which the sliding layer 4 is not provided, the heat can be supplied to the recording medium P side in a good efficiency, and the power consumption can also be saved. It can also be intended to shorten the rise time.

As materials therefor, those having high heat resistance, having high strength and capable of providing smooth surface may be selected without any particular limitations. Such materials for the release layer 3 may preferably be polyimide resins or the like.

The sliding layer 4 may optionally be incorporated with fluorine resin powder, graphite, molybdenum disulfide or the like as a sliding agent.

The sliding layer 4 may preferably have a thickness of 5 μm or more, and particularly 10 μm or more, and preferably 100 μm or less, and particularly 60 μm or less. If the sliding layer 4 is too thin, the layer may have insufficient durability. If the sliding layer 4 is too thick, the fixing belt may have so large heat capacity as to result in a long rise time.

Such a sliding layer 4 may be formed by a known method. For example, it may be formed by a method in which a liquid material is coated, followed by hardening by drying, or a method in which a material made previously into a tube is stuck.

(2) Image Heat Fixing Assembly 100

The image heat fixing assembly of the present invention is described below. The image heat fixing assembly of the present invention has a fixing belt and a pair of pressure contact members which are mutually in pressure contact via the fixing belt. The inner surface of the fixing belt is slidable on one of the pressure contact members, and an image held on a recording medium are heat-fixed by the aid of the heat conducted from the fixing belt. The fixing belt used here is the above fixing belt of the present invention. In particular, preferred is an image heat fixing assembly having a magnetic-flux generation means which generates magnetic flux, where the fixing belt generates heat by the aid of the magnetic flux generated by this magnetic-flux generation means to heat-fix the image held on the recording medium; or an image heat fixing assembly in which the pressure contact member sliding on the fixing belt has a heating element, and the image held on the recording medium is heat-fixed by the aid of the heat conducted from the heating element.

First Embodiment

Figure 5:
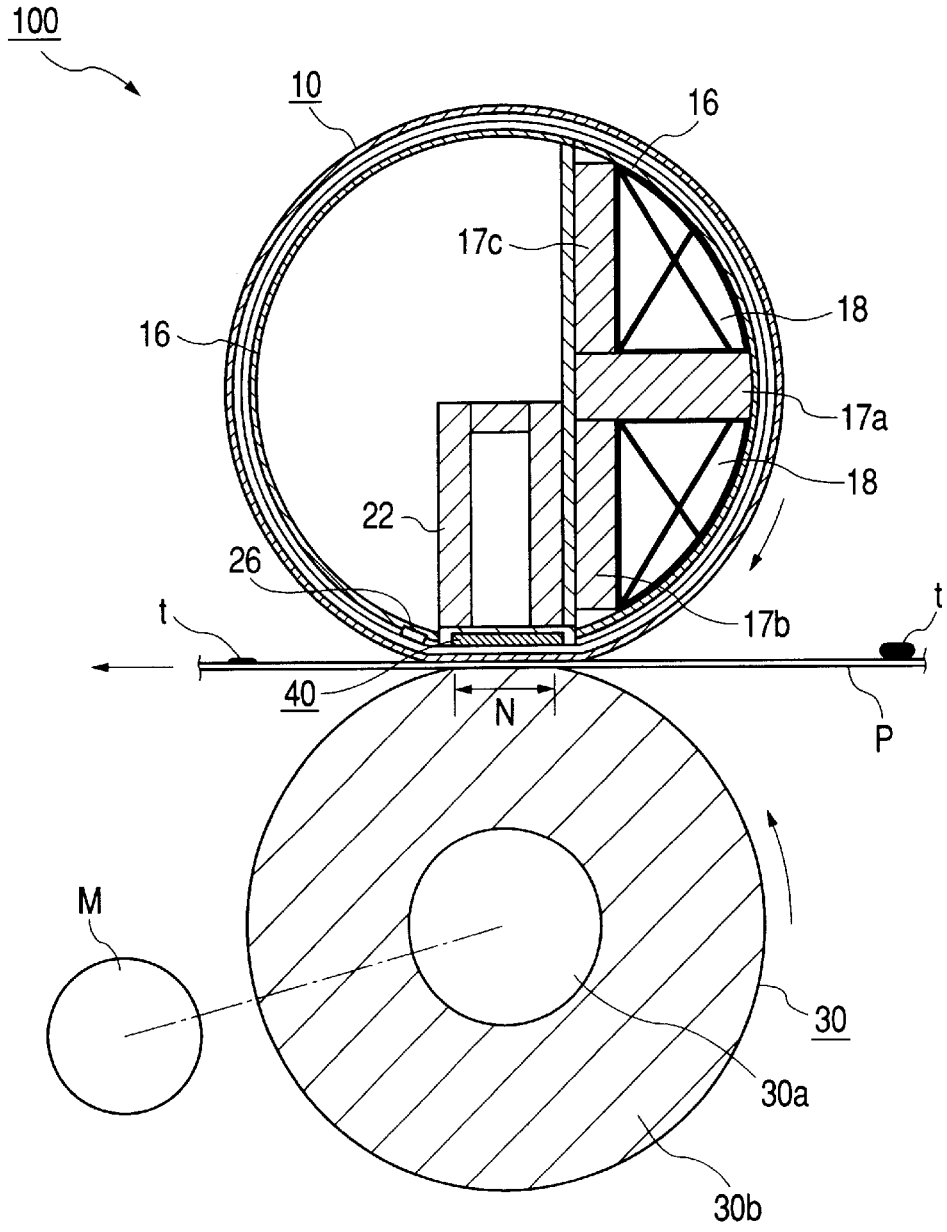
FIG. 5 is a schematic view showing the construction of an image heat fixing assembly used in First Embodiment.

FIG. 5 is a cross-sectional diagrammatic view showing the main part of an image heat fixing assembly 100 of this embodiment In this embodiment, the image heat fixing assembly 100 is the assembly of an electromagnetic-inductlon heating system, and a fixing belt 10 is the above fixing belt of the present invention.

Figure 6:
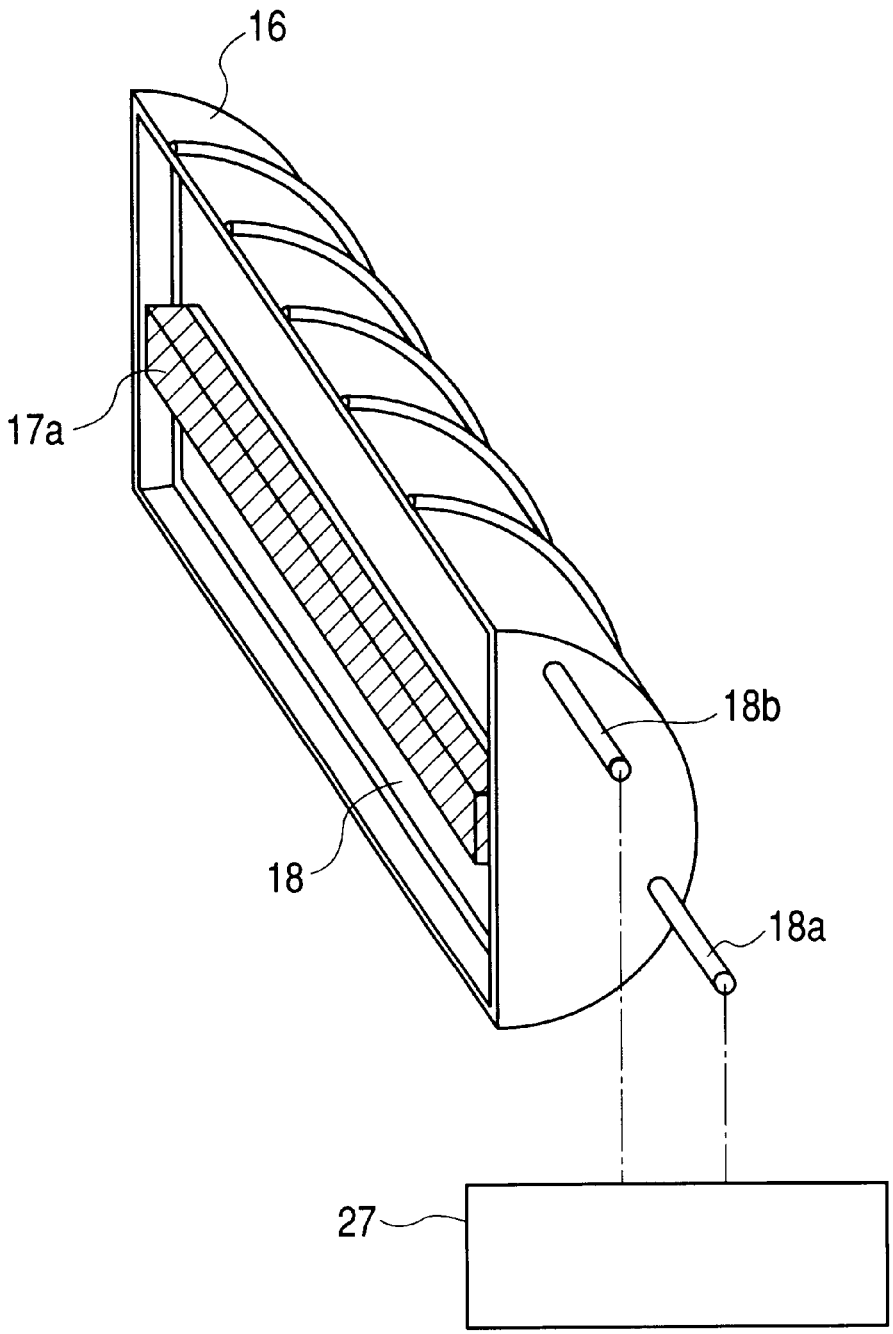
FIG. 6 is a diagrammatic view of a magnetic-field generation means of the image heat fixing assembly used in First Embodiment.

The magnetic-flux generation means consists basically of a magnetic core 17 (17*a* to 17*c*) and an exciting coil 18. FIG. 6 is a diagrammatic view of the magnetic-field generation means of this image heat fixing assembly.

The magnetic core 17 is a member having high permeability, and may preferably be those formed of materials used in cores of transformers, such as ferrite and Permalloy. In particular, it is preferable to use ferrite, which may cause less loss even at 100 kHz or more.

In the exciting coil 18, a bundle of a plurality of small-gauge wires (i.e., a bundled cable) made of copper the individual wires of which have each been one by one insulation-coated is used as a conductor wire (electric wire) constituting a coil. This is turned a plurality of times to form an exciting coil. In this embodiment, eleven turns of the bundled cable form the exciting coil 18.

As insulation coatings, coatings having heat resistance may preferably be used, taking into account the heat conduction attributable to the heat generation of the fixing belt 10. For example, coatings formed of polyimide resin or poly (amide-imide) resin may be used. Here, a pressure may be applied from the outside of the exciting coil 18 to improve its closeness.

An insulating member, which also serves as a belt guide member, is provided between the magnetic-flux generation means and the fixing belt 10. As materials for the insulating member, those having excellent insulating properties and good heat resistance may be used. For example, they may preferably include phenolic resins, fluorine resins, polyimide resins, polyamide resins, poly(amide-imide) resins, PEEK (polyether ether ketone) resins, PES (polyether sulfone) resins, PPS (polyphenylene sulfide) resins, PFA (tetrafluoroethylene/perfluoroalkyl ether copolymer) resins, PTFE (polytetrafluoroethylene) resins and FEP (tetrafluoroethylene/hexafluoropropylene copolymer) resins and LCP (liquid-crystal polyester).

As shown in FIG. 6, an excitation circuit 27 is connected to the exciting coil 18 at its electricity feeding terminals 18*a* and 18*b*. This excitation circuit 27 is so made that a high-frequency power of preferably from 20 kHz to 500 khz can be produced by a switching power source. The exciting coil 18 generates alternating magnetic flux upon application of alternating current (high-frequency current).

Figure 7:
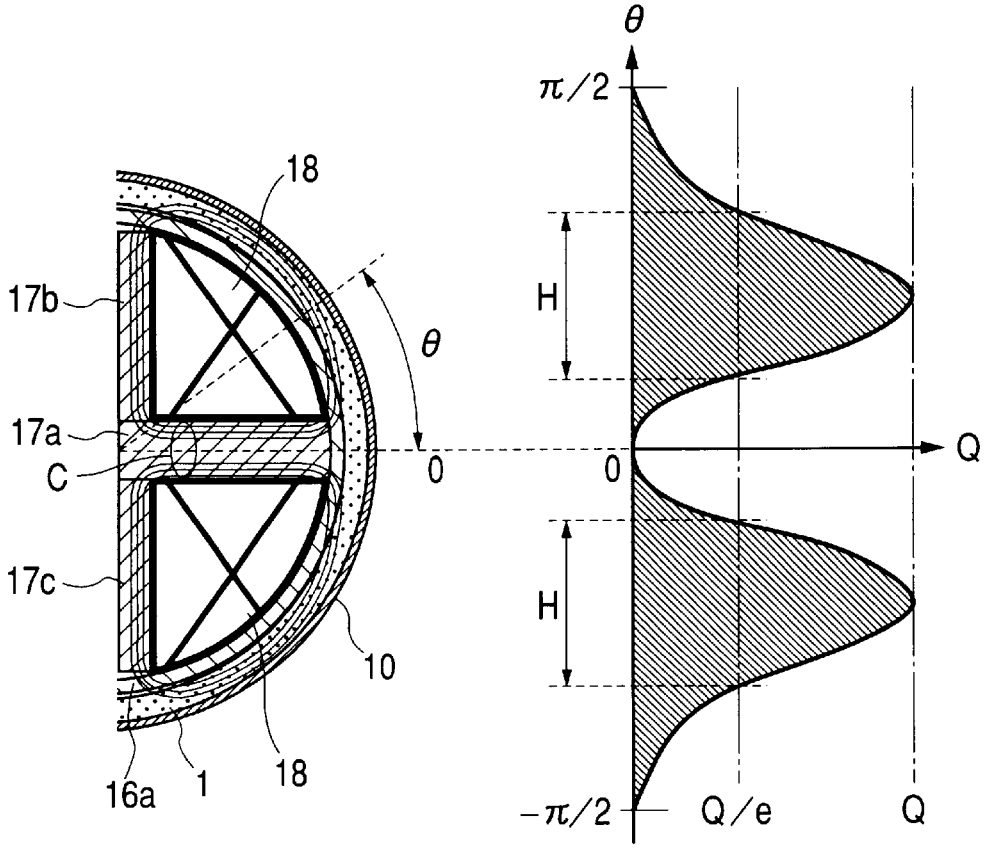
FIG. 7 illustrates the relationship between the magnetic-field generation means and the heat generation quantity Q of the image heat fixing assembly used in First Embodiment.

FIG. 7 diagrammatically illustrates how the alternating magnetic flux is generated. Magnetic flux C shows part of the alternating magnetic flux generated.

The alternating magnetic flux (C) introduced into the magnetic core 17 causes the metal layer (electromagnetic-induction heat generation layer) 1 formed of the electroformed nickel, to produce eddy currents by electromagnetic induction. The eddy currents cause the electromagnetic-induction heat generation layer 1 to produce Joule heat (eddy current loss) in virtue of the specific resistance of the electromagnetic-induction heat generation layer 1. Heat generation quantity Q depends on the density of magnetic flux passing through the electromagnetic-induction heat generation layer 1, and shows such a distribution as shown in the graph of FIG. 7. In the right drawing in FIG. 7, the ordinate indicates by an angle θ the position of the electromagnetic-induction heat generation layer. The abscissa indicates the heat generation quantity Q at the electromagnetic-induction heat generation layer of the fixing belt 10. Here, heat generation zones H are defined to be regions where the heat generation quantity Q is Q/e or more, assuming the maximum heat generation quantity as Q. This is the region where the heat generation quantity necessary for the fixing is obtained.

The temperature at a fixing nip N (FIG. 5) of this image heat fixing assembly is so temperature-controlled that a stated temperature can be maintained by controlling the feeding of electric current to the exciting coil 18 by means of a temperature control system having a temperature detection means (not shown). In FIG. 5, a temperature sensor 26 is a thermistor or the like which detects the temperature of the fixing belt 10. In this embodiment, it is so set that the temperature of the fixing nip N is controlled on the basis of the temperature information of the fixing belt 10, obtained by measurement with the temperature sensor 26.

A pressure roller 30 as one of a pair of pressure contact members is constituted of a mandrel 30*a* and a heat-resistant elastic material layer 30*b* formed of silicone rubber, fluorine rubber, fluorine resin or the like with which the periphery of the mandrel is covered in a concentrically integral form by molding in a roller. It is so provided that both ends of the mandrel 30*a* are rotatively supported on bearings between plate metals of a chassis (not shown).

Between both ends of a pressing rigid stay 22 and spring bearing members (not shown) on the chassis side of the assembly, pressure springs (not shown) are respectively provided in a compressed state so that a press-down force acts on the pressing rigid stay 22. Thus, the bottom surface of a sliding plate 40 provided at the bottom surface of a belt guide member 16 and the top surface of the pressure roller 30 come into pressure contact holding the fixing belt 10 between them to form the fixing nip N in a stated width. Here, as materials for the belt guide member 16, it is preferable to use heat-resistant phenolic resin, LCP (liquid-crystal polyester) resin, PPS (polyphenylene sulfide) resin, PEEK (polyether ether ketone) resin or the like, having excellent heat resistance.

The pressure roller 30 is rotatively driven by a drive means M in the anti-clockwise direction as shown by an arrow. In virtue of a frictional force produced between the pressure roller 30 and the outer surface of the fixing belt 10 by the rotational drive of the pressure roller 30, a rotational force acts on the fixing belt 10. Thus, the fixing belt 10 is rotated along the outer surface of the belt guide member 16 in the clockwise direction as shown by an arrow and at a peripheral speed corresponding substantially to the rotational speed of the pressure roller 30 while sliding, at its inner surface, on the bottom surface of the sliding plate 40 at the fixing nip N.

In this way, the pressure roller 30 is rotatively driven and, with its rotation, the fixing belt 10 is rotated, where the electromagnetic-induction heat generation of the fixing belt 10 is effected as described above, by supplying electricity to the exciting coil 18 from the excitation coil 27. In the state the temperature of the fixing nip N has been raised and controlled to the stated temperature, a recording medium P transported from an image-forming means section (not shown) and on which an unfixed toner image t has been formed is guided to the fixing nip N between the fixing belt 10 and the pressure roller 30 with its image surface upside, i.e., facing the outer surface of the fixing belt 10. Then, at the fixing nip N, the image surface comes into close contact with the outer surface of the fixing belt 10, where the recording medium P is sandwiched and transported on through the fixing nip N together with the fixing belt 10. In this course, the unfixed toner image t is heated by the electromagnetic-induction heat generation of the fixing belt 10, and heat-fixed to the surface of the recording medium P. The recording medium P having passed through the fixing nip N is separated from the outer surface of the rotating fixing belt 10, and transported on until it is put out. The heat-fixed toner image on the recording medium becomes cool after it has passed through the fixing nip N, and turns into a permanent fixed image.

In this embodiment, the image heat fixing assembly is not provided with any oil application mechanism for preventing offset. Such an oil application mechanism may be provided when a toner not incorporated with any low-softening substance is used. Also when a toner incorporated with a low-softening substance is used, oil may be applied or the recording medium may be separated with cooling.

The pressure roller 30 may also have, without limitation on its form, other forms such as a rotatively movable film type. In order to feed heat energy also from the pressure roller 30 side, a heating means of electromagnetic-induction heating or the like may also be provided on the pressure roller 30 side so that it can be so constructed as to be heated and temperature-controlled to the stated temperature.

Second Embodiment

The fixing belt of the present invention may also be used in a fixing assembly of a belt heating system making use of a ceramic heater.

Figure 8:
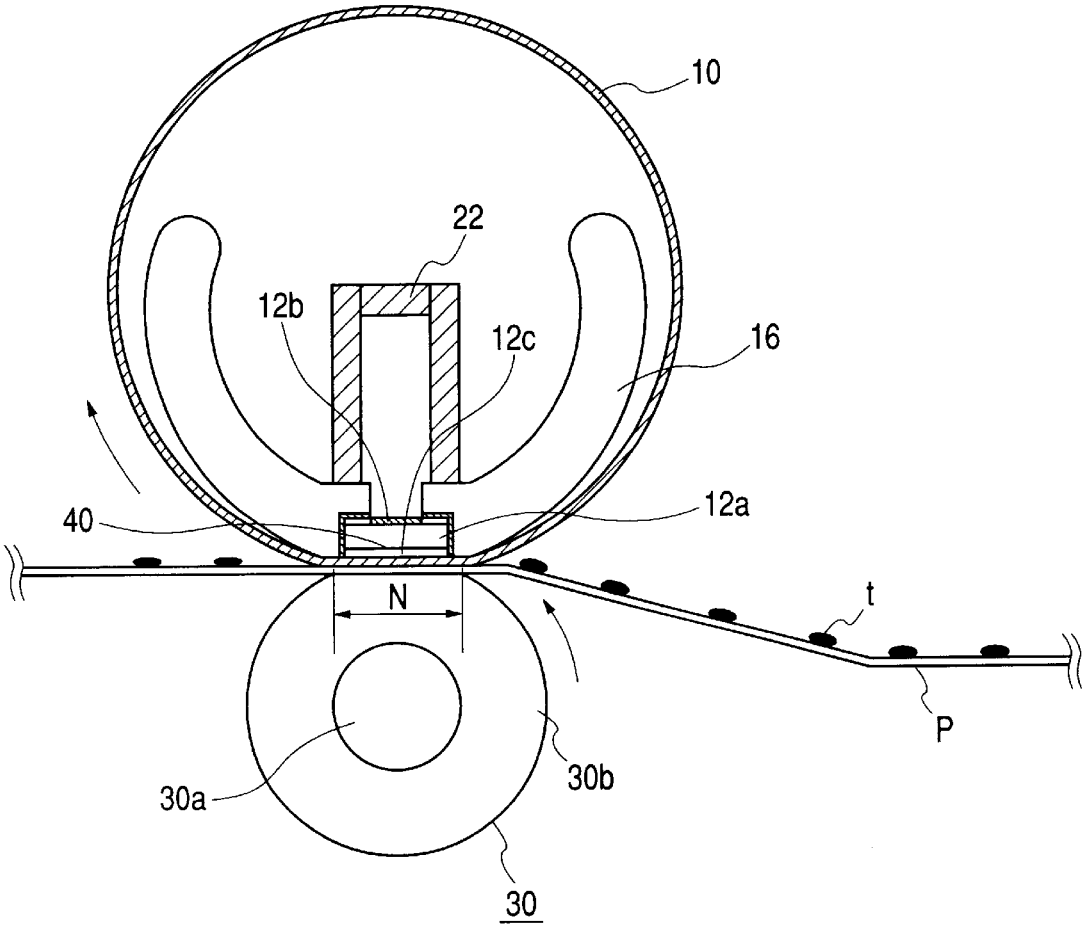
FIG. 8 is a schematic view showing the construction of an image heat fixing assembly used in Second Embodiment.

FIG. 8 is a cross-sectional diagrammatic view showing an example of an image heat fixing assembly in this embodiment. In this embodiment, the image heat fixing assembly is an assembly with a belt heating system making use of a ceramic heater, and a fixing belt 10 is the above fixing belt of the present invention.

A belt guide 16 is a heat-resistant and heat-insulating belt guide. A ceramic heater 12 (12*a* to 12*c*) as a heating element is stationarily supported in the state it is inserted to a groove formed and provided at the bottom surface of the belt guide 16 at substantially the middle thereof in its lengthwise direction. Then, the fixing belt 10 of the present invention, which may be cylindrical or endless, is loosely externally fitted over the belt guide 16.

A pressing rigid stay 22 is kept inserted to the inside of the belt guide 16.

A pressure member 30 is, in this embodiment, an elastic pressure roller. This pressure roller 30 is constituted of a mandrel 30*a* and an elastic layer 30*b* of silicone rubber or the like provided on the mandrel so as to have a low hardness. It is so provided that both ends of the mandrel 30*a* are rotatively supported on bearings between chassis side plates (not shown) on the front and back sides. This elastic pressure roller 30 may further be provided on its periphery with a fluorine resin layer formed of PTFE (polytetrafluoroethylene), PFA (tetrafluoroethylene/ perfluoroalkyl ether copolymer), FEP (tetrafluoroethylene/ hexafluoropropylene copolymer) or the like.

A pressure means for forming a fixing nip N and a holding means at ends of the fixing belt may have the same construction as those in First Embodiment.

The pressure roller 30 is rotatively driven by a drive means M in the anti-clockwise direction as shown by an arrow. In virtue of a frictional force produced between the pressure roller 30 and the outer surface of the fixing belt 10 by the rotational drive of the pressure roller 30, a rotational force acts on the fixing belt 10. Thus, the fixing belt 10 is rotated along the outer surface of the belt guide member 16 in the clockwise direction as shown by an arrow and at a peripheral speed corresponding substantially to the rotational speed of the pressure roller 30 while sliding, at its inner surface, on the bottom surface of the ceramic heater 12 in close contact via a sliding member 40 at the fixing nip N (pressure roller drive system).

The pressure roller 30 starts to be rotated in accordance with print start signals, and also the ceramic heater 12 starts to be heated up. In the state the peripheral speed in the rotation of the fixing belt by the rotation of the pressure roller 30 has come constant and the temperature of the ceramic heater 12 has risen to the stated temperature, a recording medium P holding a toner image t as a material to be heated is introduced into the fixing nip N between the fixing belt 10 and the pressure roller 30 with its toner-image-holding surface side on the fixing belt 10 side. Then, at the fixing nip N, the recording medium P comes into close contact with the bottom surface of the ceramic heater 12 via the fixing belt 10 and the sliding member 40, where it moves and passes through the fixing nip N together with the fixing belt 10. While moving to pass through the fixing nip, the heat of the ceramic heater 12 is imparted to the recording medium P via the fixing belt 10, so that the toner image t is heat-fixed to the surface of the recording medium P. The recording medium P having passed through the fixing nip N is separated from the outer surface of the rotating fixing belt 10 and transported on.

The ceramic heater 12 as a heating element is an oblong linear heating element with a low heat capacity whose lengthwise direction is at right angles to the direction of movement of the fixing belt 10 and recording medium P. It is basically constituted of a heater substrate 12*a* made of aluminum nitride or the like, a heat generation layer 12*b* provided on the surface of this heater substrate 12*a* in its lengthwise direction, which is a heat generation layer 12*b* provided by, e.g., applying a electrically resistant material such as Ag/Pd (silver/palladium) by screen printing or the like in a thickness of about 10 $\mu$m and a width of from 1 to 5 mm, and further provided thereon a protective layer 12*c* formed of glass, fluorine resin or the like. The ceramic heater 12 used is by no means limited to the one described above.

Then, upon electrification at both ends of the heat generation layer 12*b* of the ceramic heater 12, the heat generation layer 12*b* generates heat, and the temperature of the heater 12 rises quickly. This heater temperature is detected by a temperature sensor (not shown), and the electrification to the heat generation layer 12*b* is controlled by a control circuit (not shown) so that the heater temperature can be maintained at the desired temperature. Thus, the ceramic heater 12 is temperature-controlled.

The ceramic heater 12 is stationarily supported in the state it is inserted with its protective layer 12*c* side downward, to the groove formed and provided at the bottom surface of the belt guide 16 at substantially the middle thereof in its lengthwise direction. At the fixing nip N coming into contact with the fixing belt 10, the surface of the sliding member 40 of the ceramic heater 12 and the inner surface of the fixing belt 10 slide coming in contact with each other.

In place of the ceramic heater 12, a ferromagnetic-material metal plate such as an iron plate may be provided, and this ferromagnetic-material metal plate may be used as a heater to generate heat by the electromagnetic induction used in First Embodiment.

The pressure roller 30 may also have, without limitation on the form of a roller, other forms such as a rotatively movable film type. In order to feed heat energy also from the pressure roller 30 side, a heating means of electromagnetic-induction heating or the like may also be provided on the pressure roller 30 side so that it can be so constructed as to be heated and temperature-controlled to the stated temperature.

Other Embodiment

The construction of the image heat fixing assembly is by no means limited to the system driven by the pressure roller as in the above embodiments.

Figure 9:
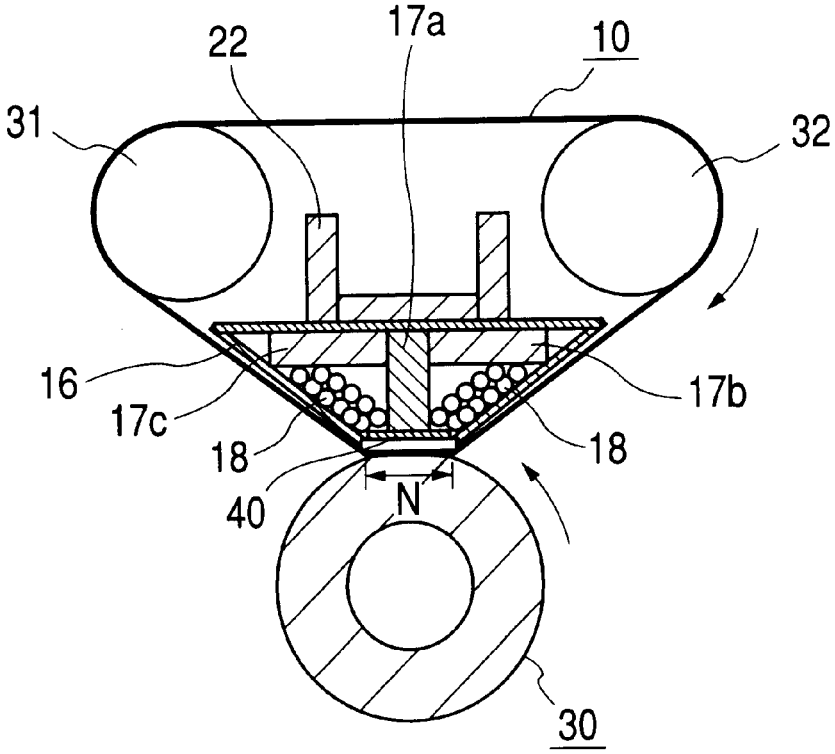
FIG. 9 is a schematic view showing the construction of an image heat fixing assembly used in Other Embodiments.

Besides the above embodiments, e.g., as shown in FIG. 9, the assembly may be so constructed that the fixing belt 10 of the present invention is put and stretched over a belt guide 16, a drive roller 31 and a tension roller 32, where the bottom surface of the belt guide 16 and a pressure roller 30 as a pressure contact member are brought into pressure contact interposing the fixing belt 10 between them to form a fixing nip N and the fixing belt 10 is rotatively driven by means of the drive roller 31. In this case, the pressure roller 30 is a follower rotating roller.

In this embodiment, too, the pressure roller 30 may also have, without limitation on the form of a roller, other forms such as a rotatively movable film type. In order to feed heat energy also from the pressure roller 30 side, a heating means of electromagnetic-induction heating or the like may also be provided on the pressure roller 30 side so that it can be so constructed as to be heated and temperature-controlled to the stated temperature.

The image heat fixing assembly of the present invention is an image heating assembly, and is not limited to the use as the image heat fixing assembly. It may also be used as an image heating assembly with which a recording medium holding an image is heated to modify its surface properties such as glossiness, or an image heating assembly for provisional fixing. Besides, it may widely be used as a heat drying assembly for materials to be heated, a heat lamination assembly and so forth, which are means and assemblies with which materials to be heated are heat-treated.

EXAMPLES

Experiment 1

As the metal layer 1, electroformed-nickel endless belts 34 mm in inner diameter and 50 μm in thickness each were selected which were produced under conditions shown in Table 1 and in the following way. A silicone rubber layer 300 μm thick as the elastic layer 2 and a PFA tube 30 μm thick as the release layer 3 were respectively overlaid via a primer to the surface of each of the electroformed-nickel endless belts, and a polyimide resin layer 15 μm in thickness as the sliding layer 4 was further overlaid, as shown in FIG. 2. Thus, various fixing belts of Examples 1 to 8 and Comparative Examples 1 to 8 were produced.

(Production of Electroformed-nickel Endless Belt)

First, as an electroforming bath, an aqueous solution bath comprised of 450 g/L of nickel sulfamate tetrahydrate, 10 g/L of nickel chloride and 40 g/L of boric acid was prepared, and then a pit preventive agent was added in a necessary amount, followed by addition of saccharin as a first brightener and 2-butine-1, 4-diol as a second brightener in the amounts shown in Table 1. The resulting bath was subjected to electrolytic purification at a low current density while being filtered in a container filled with activated carbon.

Using various nickel electroforming baths thus obtained and setting as the cathode a cylindrical mold made of stainless steel, nickel electroforming was carried out at electroforming-bath temperature and various cathode current densities and stirring-based bath flow velocities in the vicinity of the mold (flow velocities of electroforming baths in respect to the mold surface) as shown in the following Table 1, to form films of electroformed nickel of 34 mm in inner diameter and 50 μm in thickness each. Then, each electroformed nickel was removed from the mold to obtain the metal layer 1.

TABLE 1

| | Brightener | | Process conditions | | |
|---|---|---|---|---|---|
| | Saccharin (g/L) | Butinediol (g/L) | Bath temp. (° C.) | Bath flow velocity (m/sec) | Current density (A/dm$^2$) |
| Example 1 | 0.03 | 0.3 | 53 | 0.75 | 4 |
| Example 2 | 0.03 | 0.5 | 53 | 1.5 | 4 |
| Example 3 | 0.07 | 0.8 | 53 | 0.75 | 15 |
| Example 4 | 0.03 | 0.3 | 53 | 2 | 10 |
| Example 5 | 0.03 | 0.5 | 53 | 2.5 | 4 |
| Example 6 | 0.04 | 0.4 | 53 | 1.5 | 6 |
| Example 7 | 0.07 | 0.8 | 53 | 1.5 | 15 |
| Example 8 | 0.04 | 0.6 | 53 | 1.5 | 10 |
| Comparative Example 1 | 0.005 | 0.05 | 53 | 4 | 35 |
| Comparative Example 2 | 0.12 | 0.1 | 53 | 0.5 | 10 |
| Comparative Example 3 | 0.02 | 1.2 | 53 | 1.5 | 4 |
| Comparative Example 4 | 0.08 | 1.0 | 53 | 6 | 10 |
| Comparative Example 5 | 1.0 | 1.5 | 53 | 1.5 | 10 |
| Comparative Example 6 | 0.06 | 0.3 | 53 | 0.1 | 0.5 |
| Comparative Example 7 | 0.04 | 0.5 | 53 | 6 | 40 |
| Comparative Example 8 | 0.04 | 0.5 | 53 | 0.1 | 40 |

The size of crystallites of the electroformed nickel obtained was measured with an X-ray diffraction apparatus (RINT2100/PC, manufactured by Rigaku K.K.) and an analytical software JADE, on Ni (111) diffraction plane by using characteristic X-ray Cu—K (wavelength: 1.5405620 Å), and was found by including in the Hall's equation the results of measurement of the extent (integral width) of the diffraction profile. This Hall method is a method in which the extent of diffraction lines by the size and lattice strain of crystallites is extracted from the extent (integral width) of the diffraction profile to calculate the size and lattice strain of crystallites. That is, in the present invention, even the lattice strain was taken into account, and using the true extent (integral width) of the diffraction profile by the crystallites in the (111)-direction, the sizes of crystallites were determined.

The sectional crystal texture of the electroformed nickel was observed and evaluated in the following way.

Figure 10A:
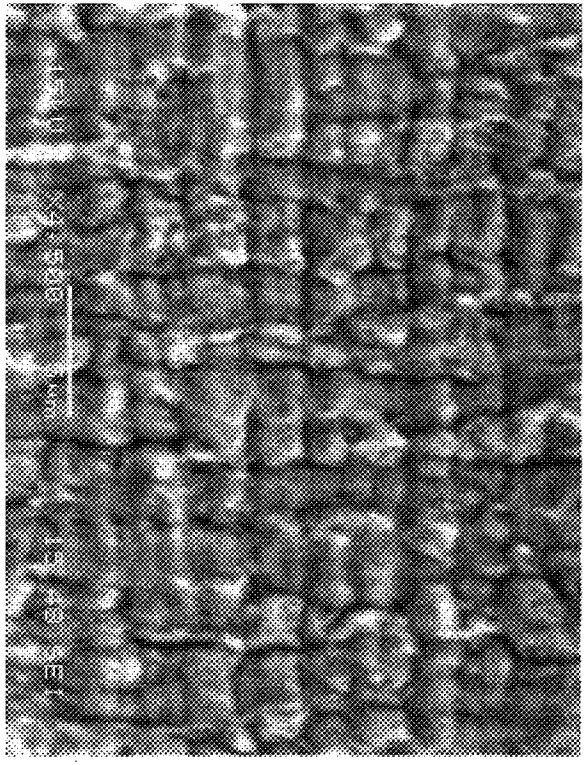
FIG. 10A is an SEM photograph of sectional crystal texture of electroformed nickel in Example 4.
Figure 10B:
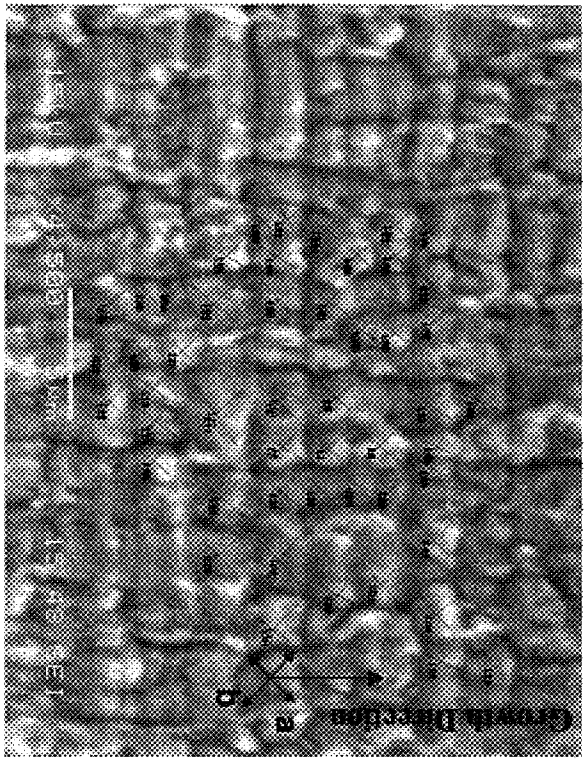
FIG. 10B shows an example of measuring the length and breadth of a crystal grain.

First, a sample (electroformed nickel) was embedded in a resin (epoxide synthetic resin:epoxide hardening solution =5:1), followed by mirror polishing and then etching with a flat solution (nitric acid acetic acid=1:1). Next, the state of polishing and etching was confirmed using an optical microscope at 1,000 magnifications so as to be well observable, and thereafter the sectional crystal texture was observed at 1,500 to 6,000 magnifications using a scanning electron microscope (SEM) manufactured by Nippon Denshi K.K., to make evaluation. Its photographs are shown in FIGS. 10A and 10B. What are shown in FIGS. 10A and 10B are SEM photographs of the sectional crystal texture of the electroformed nickel in Example 4. From the photographs, 50 pieces of crystal texture was picked up at random, and the length b and breadth a of crystal grains were measured using an image analyzing software IMAGE-PRO PLUS and an image analyzer to determine the average value of the shape factor (b/a) and the average size (b+a)/2 of crystallites.

At the same time the image analyzer was used to determine the regularity of the sectional crystal texture of electroformed nickel (as scattering of angles with respect to the direction of growth in length of 10 crystal grains which are continuously contiguous, in respect to individual crystal grains at three spots picked up at random). As the result, it was ascertained that, in the sectional crystal texture, grainy texture has a given regularity uniformly in the direction of growth or in the direction vertical to the mold surface.

The crystal texture of fine crystals was also observed using a 2010F field emission type transmission electron microscope (FE-TEM) manufactured by Nippon Denshi K.K. to confirm the presence of twin texture having small-inclination grain boundaries present in the crystal texture according to the present invention. The twins of Examples were all in a width of 0.05 μm.

The 2010F field emission type transmission electron microscope (FE-TEM) manufactured by Nippon Denshi K.K. was also used to confirm the size of crystallites.

The results of evaluation in the foregoing are shown in Table 2.

Except Comparative Example 3, stated electroformed-nickel endless belt were obtained. In Comparative Example 3, in which the butinediol was added in an amount of 1.2 g/L, the nickel film was released from the mold during the crystal growth of nickel. This is due to the fact that the nickel having been formed in a film has an excessive tensile stress.

(Production of Fixing Belt)

The electroformed-nickel endless belts (metal layers) produced as described above were each previously coated with a primer (DY35-051, available from Dow Corning Toray Silicone Co., Ltd.) by spraying, followed by drying at 150° C. for 30 minutes to form a primer layer of 5 μm in thickness.

available from Dow Corning Toray Silicone Co., Ltd.) was injected into the space between they tube and the metal layer, followed by heating in a hot-air circulating furnace at 200° C. for 30 minutes. The curing of the rubber and the bonding of respective layers were simultaneously effected, so that a silicone rubber of 300 μm in thickness as the elastic layer 2 and a PFA tube of 30 μm in thickness as the release layer 3 were laminated to the surface of each metal layer.

On the side opposite to the metal layer 1, a polyimide varnish (U-VARNISH S, available from Ube Industries) was applied, followed by curing by drying at 210° C. for 1 hour in a hot-air circulation furnace to form a polyimide resin layer of 15 μm in thickness as the sliding layer 4.

Then, the fixing belts of Examples 1 to 8 and Comparative Examples 1 to 8 thus produced were each set in the image heat fixing assembly 100 of an electromagnetic-induction heating system, and were subjected to a blank-rotation running (extensive operation) test.

(Blank-Rotation Running Test)

While controlling temperature to 220° C., the pressure roller was pressed against the fixing belt at a stated pressure to make the fixing belt rotate following to the pressure roller. As the pressure roller, a rubber roller of 30 mm in outer diameter was used which had a silicone layer of 3 mm in thickness covered with a PFA tube of 30 μm in thickness. In this experiment, conditions were so set that the pressure applied was 200 N, the fixing nip N was 8 mm×230 mm, and the surface velocity of the fixing belt was 100 mm/sec. The fixing belts were each subjected to the above blank-rotation running test. The time by which any cracking or break of the belt occurred was regarded as running time.

TABLE 2

| | Crystallite size (nm) | Crystal-grain breadth a (μm) | Crystal-grain length b (μm) | Average size (a + b)/2 (μm) | Shape factor (b/a) | Area percentage (%) | Scattering of length angles (°) (shape) | Running time (hrs) |
|---|---|---|---|---|---|---|---|---|
| Example 1 | 70 | 0.6 | 0.7 | 0.65 | 1.17 | 90 | 14 (grainy) | 600 |
| Example 2 | 80 | 0.65 | 0.95 | 0.8 | 1.26 | 95 | 12 (grainy) | 600 |
| Example 3 | 85 | 0.6 | 0.75 | 0.675 | 1.25 | 93 | 11 (grainy) | 500 |
| Example 4 | 90 | 0.9 | 1.1 | 1.0 | 1.22 | 93 | 8 (grainy) | 800 |
| Example 5 | 85 | 0.5 | 0.63 | 0.565 | 1.26 | 91 | 15 (grainy) | 650 |
| Example 6 | 90 | 0.91 | 1.15 | 1.03 | 1.26 | 90 | 11 (grainy) | 700 |
| Example 7 | 95 | 1.05 | 1.21 | 1.13 | 1.15 | 89 | 14 (grainy) | 530 |
| Example 8 | 100 | 0.85 | 1.05 | 0.95 | 1.24 | 90 | 13 (grainy) | 540 |
| Comparative Example 1 | 300 | 3 | 12 | 7.5 | 4 | 60 | 35 (columnar) | 120 |
| Comparative Example 2 | 10 | 0.03 | 0.04 | 0.035 | 1.33 | 5 | 15 (fine-crystal) | 50 |
| Comparative Example 3 | — | — | — | — | — | — | Non-film-formable | — |
| Comparative Example 4 | 35 | 0.04 | 0.05 | 0.045 | 1.25 | 10 | 15 (fine-crystal) | 90 |
| Comparative Example 5 | 15 | 0.04 | 0.045 | 0.043 | 1.13 | 10 | 16 (fine-crystal) | 40 |
| Comparative Example 6 | 45 | 0.12 | 0.35 | 0.235 | 2.9 | 55 | 34 (acicular) | 230 |
| Comparative Example 7 | 250 | 0.13 | 0.16 | 6.8 | 1.23 | 30 | 33 (columnar) | 170 |
| Comparative Example 8 | 300 | 0.1 | 0.8 | 7.2 | 8 | 70 | 38 (columnar) | 120 |

Next, a primer layer was formed on the inner surface of a PFA tube in the same way. Then the resulting PFA tube was, together with each of the above metal layers, fitted to a cylindrical mold having substantially the same inner diameter as the outer diameter of the PFA tube, so as to be on the same axis. A liquid silicone rubber (DY32-561A/B, The running time in all cases was more than 500 hours when the electroformed-nickel fixing belts of the present invention (Examples 1 to 8) were used, in which the crystallites in the crystal texture of the electroformed nickel have an average size of 0.05 μm or more and 0.2 μm or less, in the sectional crystal texture the crystal grains have an average size [(b+a)/2] of 0.1 μm or more and 3 μm or less, the area percentage occupied by texture in which the crystal shape factor (b/a) is 2 or less is 50% or more, and the scattering of angles with respect to the direction of growth in length of 10 crystal grains which are continuously contiguous is 30° or less.

On the other hand, none of fixing belts showed the running time of more than 230 hours when the electroformed-nickel fixing belts of Comparative Examples 1 to 8 were used, in which the crystallites have an average size of less than 0.05 μm, or more than 0.2 μm.

Experiment 2

The fixing assemblies used in Experiment 1 were each further mounted on a full-color laser beam printer (LBP) LASER SHOT "LBP-2040", manufactured by CANON INC., and images were reproduced to conduct a running test. Conditions were so set that the pressure applied was 200 N, the fixing nip N was 8 mm×230 mm and the process speed was 100 mm/sec. In those making use of the fixing belts of Examples 1 to 8, images were reproduced on 100,000 sheets without any troubles, and the running test was completed. On the other hand, in those making use of the fixing belt of Comparative Example 1 and the fixing belts of Comparative Examples 2 and 4 to 8, the paper feed came impossible because of break of the fixing belts on 10,000th sheet and 30,000th sheet, respectively.

Experiment 3

The fixing belts of Examples 1 to 8 were each set in the assembly (assembly 100) of a belt heating system making use of a ceramic heater 12 as a heating element as shown in FIG. 8, and were subjected to the blank-rotation running test. As a result, it was able to confirm sufficient heat resistance and durability.

What is claimed is:

1. A fixing belt comprising a release layer and a metal layer formed of electroformed nickel;

said electroformed nickel having, in its crystal texture, crystallites having an average size of 0.05 μm or more and 0.2 μm or less.

2. The fixing belt according to claim 1, wherein said electroformed nickel has, in its sectional crystal texture, crystal grains having an average size [(b+a)/2] of 0.1 μm or more and 3 μm or less where a length and breadth of a crystal grain is represented respectively by b and a, and an area percentage occupied by texture in which the crystal shape factor which is a ratio (b/a) of the length b to the breadth a of a crystal grain is 2 or less is 50% or more.

3. The fixing belt according to claim 1, wherein, in the sectional crystal texture of said electroformed nickel, said crystal texture forms grain arrangement having a regularity.

4. The fixing belt according to claim 1, wherein said electroformed nickel is one formed under conditions that electroforming bath flow velocity in respect to the surface of a mold is 0.25 m/sec or more and 5 m/sec or less, electric current applied to the mold is at a current density of 1 $A/dm^2$ or more and 30 $A/dm^2$ or less, and saccharin as a primary brightener and butinediol as a secondary brightener are in a content of 0.1 g/L or less and a content of 1 g/L or less, respectively, in the electroforming bath.

5. The fixing belt according to claim 1, which further comprises an elastic layer provided between said release layer and said metal layer.

6. The fixing belt according to claim 5, wherein said elastic layer is formed of any of a silicone rubber, a fluorine rubber and a fluorosilicone rubber.

7. An image heat fixing assembly comprising a fixing belt and a pair of pressure contact members which are in pressure contact with each other via the fixing belt; the inner surface of the fixing belt being slidable on one of the pressure contact members, and an image held on a recording medium being heat-fixed by the aid of the heat conducted from the fixing belt;

said fixing belt being the fixing belt according to claim 1.

8. The image heat fixing assembly according to claim 7, which further comprises a magnetic-flux generation means which produces a magnetic flux;

said fixing belt generating heat in virtue of the magnetic flux produced by the magnetic-flux generation means to heat and fix the image held on a recording medium.

9. The image heat fixing assembly according to claim 7, wherein the pressure contact member on which said fixing belt is slidable is a heating element;

the image held on a recording medium being heated and fixed by the aid of the heat conducted from said heating element through said fixing belt.

10. The fixing belt according to claim 1, wherein said crystallites have an average size of 0.07 to 0.1 μm.

* * * * *

UNITED STATES PATENT AND TRADEMARK OFFICE

CERTIFICATE OF CORRECTION

PATENT NO. : 6,782,230 B2
DATED : August 24, 2004
INVENTOR(S) : Zhou Yaomin et al.

It is certified that error appears in the above-identified patent and that said Letters Patent is hereby corrected as shown below:

Column 5,
Line 14, "0 $\mu$m," should read -- 0, 2 $\mu$— --.
Line 67, "layer 31" should read -- layer 3' --.

Column 6,
Line 3, "layer 41." should read -- layer 4.' --

Column 10,
Line 18, "multi" should read -- multi- --.

Column 18,
Line 51, "acid" (1st occurrence) should read -- acid: --.
Line 63, "image" should read -- image- --.

Signed and Sealed this

Twenty-eighth Day of December, 2004

JON W. DUDAS
*Director of the United States Patent and Trademark Office*

UNITED STATES PATENT AND TRADEMARK OFFICE

CERTIFICATE OF CORRECTION

PATENT NO. : 6,782,230 B2
APPLICATION NO. : 10/457360
DATED : August 24, 2004
INVENTOR(S) : Zhou Yaomin et al.

It is certified that error appears in the above-identified patent and that said Letters Patent is hereby corrected as shown below:

Title PAGE AT ITEM [73]:
Assignee: "Canon Kabushiki Kaisha, Tokyo (JP)" should read --Canon Kabushiki Kaisha, Tokyo (JP) and Canon Denshi Kabushiki Kaisha, Saitama-ken (JP)--.

Signed and Sealed this

Twenty-ninth Day of August, 2006

JON W. DUDAS
*Director of the United States Patent and Trademark Office*